US006544016B2

(12) United States Patent
Gennami et al.

(10) Patent No.: US 6,544,016 B2
(45) Date of Patent: Apr. 8, 2003

(54) SCROLL COMPRESSORS

(75) Inventors: Hiroyuki Gennami, Kariya (JP); Kazuhiro Kuroki, Kariya (JP); Kazuo Kobayashi, Kariya (JP); Shinji Tsubai, Kariya (JP); Naohiro Nakajima, Kariya (JP); Masahiro Kawaguchi, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/952,287

(22) Filed: Sep. 13, 2001

(65) Prior Publication Data

US 2003/0044297 A1 Mar. 6, 2003

(30) Foreign Application Priority Data

Sep. 14, 2000 (JP) ..... 2000-280457

(51) Int. Cl.[7] ..... F01C 1/02
(52) U.S. Cl. ..... 418/55.1; 418/188; 418/270
(58) Field of Search ..... 418/55.1, 188, 418/270

(56) References Cited

U.S. PATENT DOCUMENTS

| | | | | |
|---|---|---|---|---|
| 4,369,808 A | | 1/1983 | Hagman | |
| 5,419,690 A | * | 5/1995 | Goto et al. | 418/55.1 |
| 6,264,444 B1 | * | 7/2001 | Nakane et al. | 418/55.1 |

FOREIGN PATENT DOCUMENTS

| | | | |
|---|---|---|---|
| EP | 1 039 136 A2 | 9/2000 | |
| JP | 2-227583 | 9/1990 | |
| JP | 6-264875 | 9/1994 | |
| JP | 6-280757 | 10/1994 | ..... F04C/18/02 |
| JP | 11-2194 | 1/1999 | ..... F04C/18/02 |
| WO | WO 89/05918 | 6/1989 | |

* cited by examiner

*Primary Examiner*—Thomas Denion
*Assistant Examiner*—Theresa Trieu
(74) *Attorney, Agent, or Firm*—Morgan & Finnegan, LLP

(57) ABSTRACT

Scroll compressors may preferably include, for example, a stationary scroll, a drive shaft member, a movable scroll, a bearing member, a compression chamber, a discharge port, a discharge valve and a discharge valve clamping device. The drive shaft member may revolve around a revolution axis. The bearing member may be disposed between the movable scroll and the drive shaft member in order to transmit the revolution of the drive shaft member to the movable scroll. The compression chamber may be defined by a space formed between the stationary scroll and the movable scroll. The compression chamber compresses the fluid drawn into the compression chamber when the movable scroll revolves or orbits with respect to the stationary scroll. The discharge port is disposed within the movable scroll and is adapted to discharge fluid within the compression chamber to the opposite side of the stationary scroll. The discharge valve clamping device is preferably affixed to the movable scroll. The discharge valve clamping device may prevent the discharge valve from moving together with the bearing member when the bearing member accidentally or unintentionally revolves together with the drive shaft member and independent from the movable scroll.

18 Claims, 3 Drawing Sheets

SCROLL COMPRESSORS

BACKGROUND OF THE INVENTION

1. Field of the Invention

The present invention relates to scroll compressors that may compress a fluid (e.g. a refrigerant gas) by utilizing stationary and movable scrolls and discharge the compressed fluid through a discharge valve. The present invention particularly relates to scroll compressors that do not require a bolt to affix the discharge valve to the movable scroll. The present scroll compressors may be advantageously utilized in a vehicle air conditioning system.

2. Description of the Related Art

A known scroll compressor is disclosed in Japanese Laid-open Patent Publication No. 11-2194 and includes a stationary scroll and a movable scroll. A compression chamber is defined by a space between the stationary scroll and the movable scroll. When the movable scroll orbits with respect to the stationary scroll, the volume of the compression chamber is reduced and thus, the fluid drawn into the compression chamber is compressed and discharged from the discharge port. The discharge port is disposed within the movable scroll at the location corresponding to the compression chamber in its minimum volume. The discharge port opens and closes by means of a reed-type discharge valve. When the discharge valve closes the discharge port, backflow of the compressed fluid into the compression chamber can be prevented. The discharge valve includes a reed valve and a retainer for the reed valve. A bolt affixes the reed valve and the retainer to the base plate of the movable scroll at a position that is on the opposite side of the stationary scroll.

Labor-intensive work is necessary to affix the bolt. Moreover, because the thickness of the base plate of the movable scroll is increased due to the bolt that connects the discharge valve to the movable scroll, the space proximal to the discharge port must be increased and accordingly, dead volume increases. The increased dead volume decreases compression efficiency.

SUMMARY OF THE INVENTION

It is, therefore, an object of the invention to provide improved scroll compressors that do not require a bolt to couple or affix the discharge valve to the movable scroll.

In representative scroll compressors according to the present teachings, a discharge valve may preferably be coupled or affixed to a movable scroll by means of a discharge valve clamping device that extends between a bearing member and the discharge valve. Further, the discharge valve clamping device may prevent the discharge valve from moving together with the bearing member if the bearing member unintentionally or accidentally revolves or orbits together with the drive shaft member and independent from the movable scroll. For example, the bearing member may revolve independently of the movable scroll if the bearing member is pressure-joined (frictional fit) to the movable scroll and if the bearing member separates from the movable scroll due to differences between the thermal expansion co-efficient of the bearing member and the movable scroll. Naturally, the thermal expansion coefficient may differ if different materials are utilized to construct the bearing member and the movable scroll.

According to the present teachings, the discharge valve can be securely positioned with respect to the movable scroll because the discharge valve is prevented from moving together with the bearing member even if the bearing member unintentionally or accidentally revolves or orbits together with the drive shaft member and independently from the movable scroll. An advantageous feature of the present teachings is that a bolt is not required to couple or affix the discharge valve to the movable scroll.

Other objects, features and advantage of the present invention will be readily understood after reading the following detailed description together with the accompanying drawings and the claims.

DETAILED DESCRIPTION OF THE INVENTION

Figure 1:
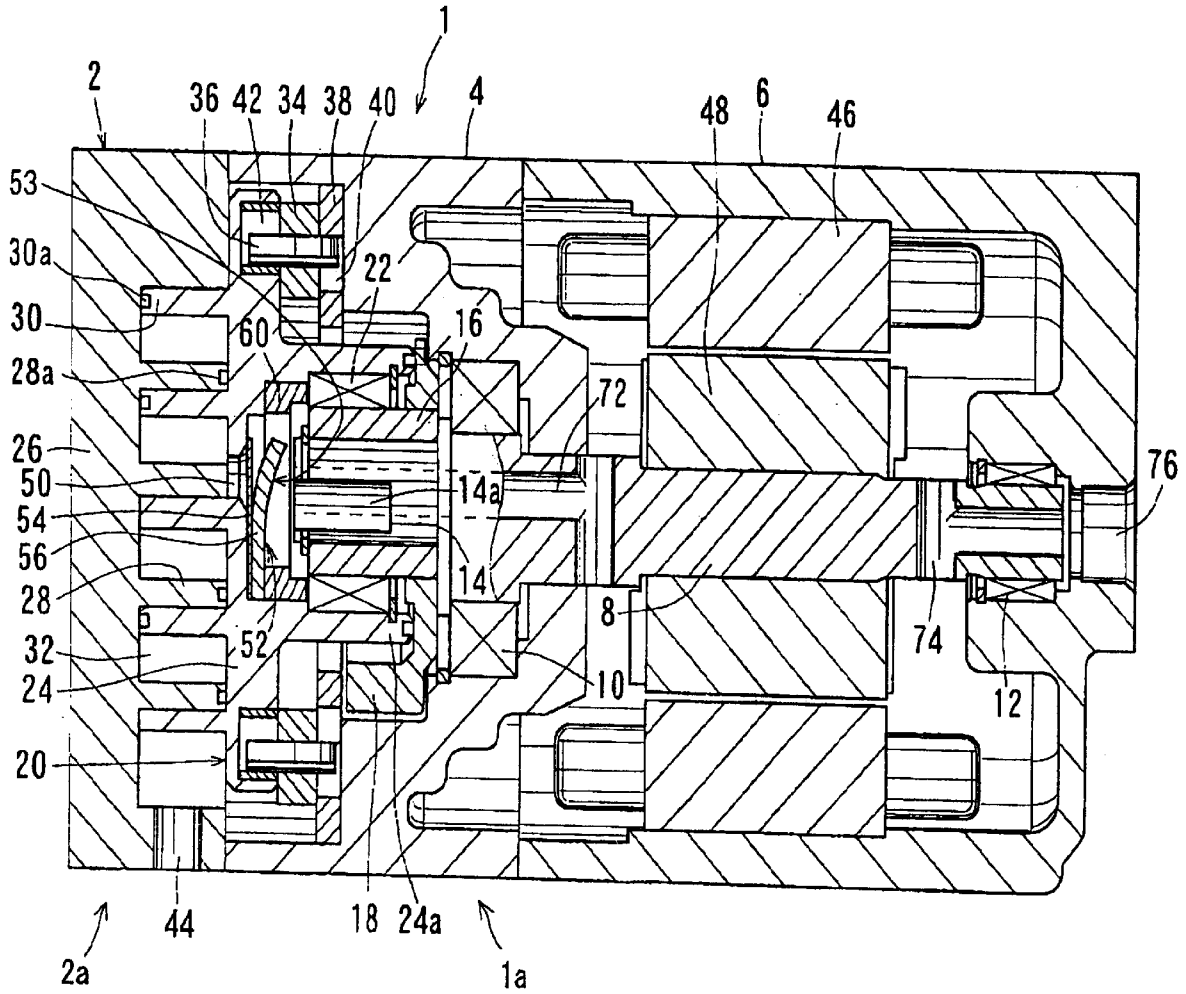
FIG. 1 is a longitudinal cross sectional view showing a scroll compressor of a first representative embodiment.

Representative scroll compressors are taught that may include, for example, a stationary scroll, a drive shaft member, a movable scroll, a bearing member, a compression chamber, a discharge port, a discharge valve and a discharge valve clamping device.

The drive shaft member may revolve around a revolution axis. In other words, the drive shaft member may orbit around the center of the rotation. An offset drive shaft may preferably be utilized with a drive shaft to form a drive shaft member. The drive shaft member may drive the movable scroll. The bearing member is preferably disposed between the movable scroll and the drive shaft member in order to transmit the revolution of the drive shaft member around the revolution axis to the movable scroll. The compression chamber may be defined by a space formed between the stationary scroll and the movable scroll. The compression chamber compresses the fluid drawn into the compression chamber when the movable scroll revolves or orbits with respect to the stationary scroll.

The discharge port is disposed within the movable scroll and is arranged and constructed to discharge the fluid within the compression chamber to the opposite side of the stationary scroll. The discharge valve may open and close the discharge port. The discharge valve clamping device is preferably affixed to the movable scroll. The discharge valve clamping device may prevent the discharge valve from moving together with the bearing member if the bearing member accidentally or unintentionally revolves together with the drive shaft member and independently from the movable scroll. The discharge valve clamping device may preferably comprise a clamping member. The clamping member may preferably clamp the discharge valve between the movable scroll and the bearing member. The clamping member may preferably be fixed to the movable scroll. By attaching the clamping member to the movable scroll, the clamping member will not transmit the rotation of the drive shaft member to the discharge valve. Preferably, the movable scroll may include a boss that extends toward the drive shaft member and the clamping member may be pressure-joined (e.g., frictionally fit) to the inner surface of the boss of the movable scroll. Further, the discharge valve clamping device may preferably be separated by a clearance from the bearing member in order to prevent the bearing member from transmitting its movement to the discharge valve.

In another aspect of the present teachings, the discharge valve clamping device may preferably include a discharge valve clamping member and an engaging member. The discharge valve clamping member may extend between the bearing member and the discharge valve. Further, the engaging member may engage the discharge valve with the movable scroll such that the engaging member prevents the discharge valve from moving together with the rotation of the bearing member if the bearing member accidentally or unintentionally revolves or orbits together with the drive shaft member and independently from the movable scroll.

Preferably, the engaging member may be defined by a concave-convex structure. The concave portion may preferably be provided on either of the movable scroll and the discharge valve. The convex portion joins with the concave portion and may preferably be provided on the other of the movable scroll and the discharge valve.

Each of the additional features and method steps disclosed above and below may be utilized separately or in conjunction with other features and method steps to provide improved scroll compressors and methods for designing and using such scroll compressors. Representative examples of the present invention, which examples utilize many of these additional features and method steps in conjunction, will now be described in detail with reference to the drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe some representative examples of the invention, which detailed description will now be given with reference to the accompanying drawings.

A representative scroll compressor 1 is shown in FIG. 1 and may preferably be utilized within a refrigerant circulation circuit in a vehicle air-conditioning system. As shown in FIG. 1, the representative scroll compressor 1 includes a housing 1*a* defined by a center housing 4, a motor housing 6 and an end housing 2*a*. A stationary scroll 2 is disposed within the end housing 2*a*. A movable scroll 20 and other devices that drive the movable scroll 20 are also disposed within the housing 1*a*. One end surface of the center housing 4 is coupled to the end housing 2*a* and another end surface of the center housing 4 is coupled to the motor housing 6. A drive shaft 8 is rotatably supported by radial beatings 10 and 12 in both the center housing 4 and the motor housing 6. Within the center housing 4, a crank shaft 14 is integrally coupled to the end of the drive shaft 8. In the representative embodiments, the crank shaft 14 and the drive shaft 8 are one representative example of a drive shaft member according to the present teachings.

Two mutually parallel planar portions 14*a* are formed on the crank shaft 14. In FIG. 1, however, only one planar portion 14*a* is shown for the sake of convenience of explanation. A bush 16 is joined to the crank shaft 14 by means of the planar surfaces 14*a* so that the bush 46 may rotate together with the crank shaft 14. A balancing weight 18 is attached to one end of the bush 16 so that the balancing weight 18 can rotate together with the crank shaft 14. The movable scroll 20 includes a tubular boss 24*a* that is provided on the surface opposite to the stationary scroll 2 (on the right side of the movable scroll 20 in FIG. 1). Further, a needle bearing 22 couples the bush 16 to the inner circumferential surface of the boss 24*a* to rotate relatively. The needle bearing 22 is one representative example of a "bearing member" as utilized in the present teachings.

The stationary scroll 2 includes a stationary volute wall 28 that protrudes from a base plate 26 of the stationary scroll 2 towards the movable scroll 20. The movable scroll 20 includes a movable volute wall 30 that protrudes from the base plate 24 of the movable scroll 20 towards the stationary scroll 2. The stationary volute wall 28 and the movable volute wall 30 are disposed adjacent to each other and preferably aligned to engage or mesh with each other. A tip seal 28*a* is provided on the top end of the stationary volute wall 28 and a tip seal 30*a* is provided on the top end of the movable volute wall 30. The volute walls are also known in the art as spiral wraps and these terms can be utilized interchangeably.

The stationary volute wall 28 and the movable volute wall 30 make contact with each other at a plurality of positions and are positioned in meshing engagement. As the result, a plurality of compression chambers 32 with a crescent shape is defined within a space surrounded by the stationary scroll base plate 26, the stationary volute wall 28, the movable scroll base plate 24 and the movable volute wall 30. When the drive shaft 8 rotates, the crank shaft 14 revolves or orbits around the rotational axis of the drive shaft 8. The rotational axis may be defined as the center, longitudinal axis of the drive shaft 8. Thus, the distance between the crank shaft 14 and the rotational axis of the drive shaft 8 defines the diameter of the orbital path. When the movable scroll 20 revolves or orbits about the rotational axis of the drive shaft 8, the balancing weight 18 offsets the centrifugal force caused by the revolution of the movable scroll 20.

Figure 2:
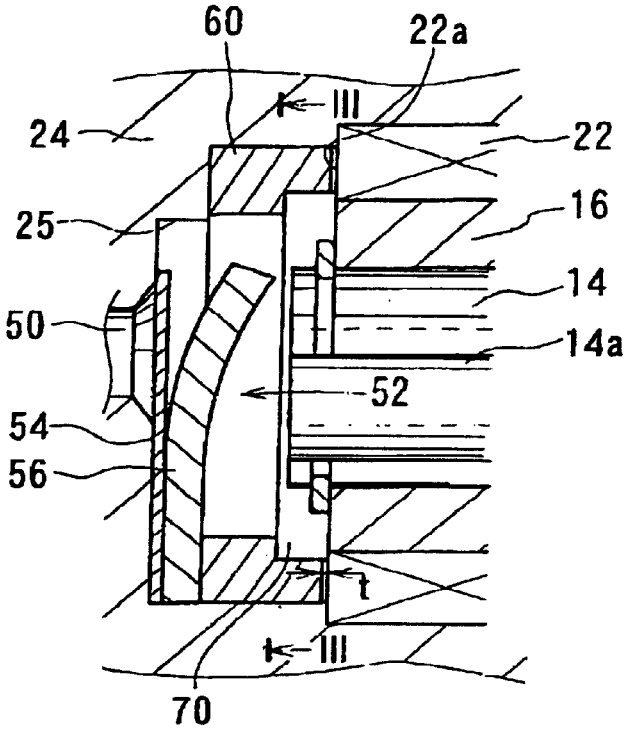
FIG. 2 is a partially enlarged view of FIG. 1.
Figure 3:
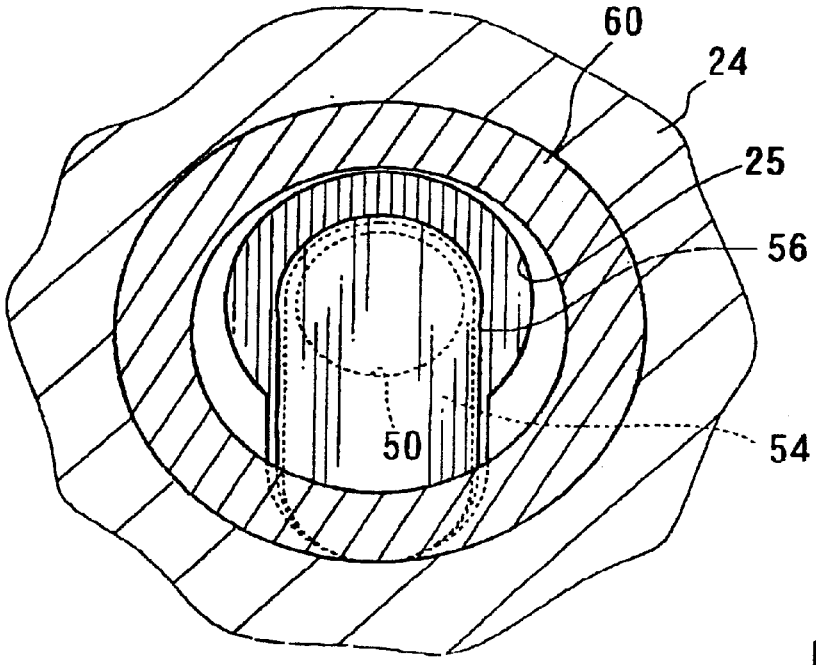
FIG. 3 is a view of the cross-section along line III—III shown in FIG. 2.

As shown in FIGS. 2 and 3, a discharge valve 52 is provided on the rear surface of the movable scroll base plate 24 (i.e., the surface facing the crank shaft 14). A discharge port 50 is defined within the movable scroll base plate 24 and the discharge valve 52 is disposed at the discharge port 50 in order to open and close the discharge port 50. The discharge valve 52 includes a reed valve 54 and a retainer 56. The reed valve 54 opens and closes the discharge port 50 and preferably has an area or shape that is sufficient to cover the opening of the discharge port 50. The retainer 56 supports the reed valve 54. The reed valve 54 and the retainer 56 are provided in a valve housing 25 formed in the rear surface of the movable scroll base plate 24.

The reed valve 54 opens and closes based upon the pressure difference between the pressure within a space 70 and the pressure within the discharge port 50 or compression chamber 32. The reed valve 54 opens the discharge port 50 when the pressure within the compression chamber 32 is greater than the pressure within the space 70. The reed valve 54 closes the discharge port 50 when the pressure within the compression chamber 32 is lower than the pressure within the space 70. The retainer 56 supports the reed valve 54 and also defines the maximum aperture of the reed valve 54.

A discharge valve clamping ring 60 is provided within the valve housing 25. The discharge valve clamping ring 60 is press-fitted (i.e., frictionally fitted) within the inner circumferential surface of an annular portion of the movable scroll forming the boss 24*a* and is thus integrated with the movable scroll 20. The reed valve 54 and the valve guard 56 are clamped or secured between the discharge valve clamping ring 60 and the movable scroll base plate 24. This press-fitted discharge valve clamping ring 60 is one representative example of a "discharge valve clamping device" and "means for preventing the discharge valve from rotating" according to the present teachings. By press-fitting the discharge valve clamping ring 60 within the inner circumferential surface of the boss 24*a,* the discharge valve 52 can be prevented from moving together with the needle bearing 22 if the needle bearing 22 accidentally or unintentionally revolves together with the offset shaft 14 and independent from the movable scroll 20. As the result, the positional relationship between the discharge valve 52 and the discharge port 50 can be reliably maintained. As shown in FIG. 2, a small clearance "t" separates the discharge valve clamping ring 60 from the end face of the needle bearing 22. Thus, the needle bearing 22 can not transmit rotational movement to the discharge valve clamping ring 60 due to the clearance "t" that separates the discharge valve clamping ring 60 from the needle bearing 22.

As shown in FIG. 1, a rotary ring 34 is disposed between the base plate 24 of the movable scroll 20 and the center housing 4. The rotary ring 34 includes auto-rotation preventing pins 36 that project toward the movable scroll 20. In this embodiment, a total of four auto-rotation preventing pins 36 are provided. However, only two auto-rotation preventing pins 36 are shown in FIG. 1. A bearing plate 38 is provided between the center housing 4 and the rotary ring 34. The auto-rotation preventing pins 36 and auto-rotation preventing holes 40 are circumferentially aligned within the bearing plate 38. Thus, each auto-rotation preventing pin 36 respectively engages with an auto-rotation preventing hole 40 defined within the bearing plate 38. Further, each auto-rotation preventing pin 36 respectively engages with an auto-rotation preventing hole 42 defined within base plate 24 of the movable scroll 20. The respective end portions of the auto-rotation preventing pins 36 are inserted into the corresponding auto-rotation preventing holes 40, 42.

A stator 46 is provided on the inner circumferential surface of the motor housing 6. Further, a rotor 48 is coupled to the drive shaft 8. The stator 46 and the rotor 48 define an electric motor that rotates the drive shaft 8. Thus, the present scroll compressors are particularly useful for hybrid or electric cars that operate using electric power. However, an electric motor is not essential to the present teachings and the present scroll compressor can be easily modified for use with internal combustion engines.

When the drive shaft 8 rotates together with the crank shaft 14, the crank shaft 14 revolves (orbits) around the rotational axis of the drive shaft 8. Also, the crank shaft 14 rotates around its auto-rotating axis (which is same as the rotational axis of the crank shaft 14). However, the auto-rotation preventing pin 36 only permits the movable scroll 20 to receive the orbital movement of the crank shaft 14 by means of the needle bearing 22. Further, the auto-rotation of the crank shaft 14 will not be transmitted to the movable scroll due to the auto-rotation preventing pin 36. As a result of the orbital movement of the movable scroll 20 with respect to the stationary scroll 2, refrigerant gas (fluid) is drawn from a suction port 44 and closed into the compression chamber 32, which is defined between the stationary scroll 2 and the movable scroll 20. In conjunction with the revolution of the movable scroll 20, the surface of the auto-rotation preventing pin 36 slides along the surface of the respective auto-rotation preventing holes 40 and 42. The inner diameter "D" of the auto-rotation preventing holes 40, 42, the outer diameter "d" of the auto-rotation preventing pins 36, and the revolutionary (orbital) radius "r" of the bush 16 are preferably defined in a relationship such as "D=d+r". Due to this relationship, the revolutionary (orbital) radius of the movable scroll 20 is defined by "r", and the orbiting ring 34 revolves at a radius that is one-half of the revolutionary radius "r" of the movable scroll 20.

While the crank shaft 14 revolves, the orbiting ring 34 is prevented from auto-rotating because the inner circumferences of the auto-rotation preventing holes 40 contact the auto-rotation preventing pins 36 on the orbiting ring 34. Further, the movable scroll 20 is prevented from auto-rotating around the central axis of the bush 16 because the inner circumferences of the auto-rotation preventing holes 42 are in contact with the auto-rotation preventing pins 36 on the orbiting ring 34.

When the crank shaft 14 revolves, the movable scroll 20 connected to the crank shaft 14 by means of the needle bearing 22 orbits or revolves along a circular path. When the movable scroll 20 revolves or orbits with respect to the stationary scroll 2, the refrigerant gas (fluid) is drawn from the suction port 44 and is closed into the compression chamber 32 and the compression chamber 32 reduces its volume as the compression chamber 32 moves toward the center of the stationary and movable scrolls 2, 20. Due to the volume reduction of the compression chamber 32, the refrigerant gas is compressed and reaches a high pressure state.

The compressed high-pressure refrigerant gas is discharged from the discharge port 50 to the high-pressure chamber 53 when the discharge valve 52 opens the discharge port 50. The space 70 communicates with the interior of the motor housing 6 via a passage 72 formed inside the crank shaft 14 and the drive shaft 8. Further, the refrigerant gas introduced into the motor housing 6 is discharged from the passage 74 provided in the drive shaft 8 to an external air conditioning circuit via an outlet 76 formed in a wall portion of the motor housing 6. Because the refrigerant gas is communicated through the interior of the motor housing 6, the refrigerant gas can cool the electric motor (i.e. rotor 48 and stator 46) during operation.

According to the representative scroll compressor 1, the discharge valve clamping ring 60 that clamps the discharge valve 52 is pressure-joined (i.e., frictionally fitted) onto the movable scroll 20. Thus, the discharge valve 52 is prevented from moving together with the needle bearing 22 even if the needle bearing 22 accidentally or unintentionally revolves independently from the movable scroll 20. In other words, the movement of the needle bearing 22 can be stopped or prevented from being transmitted to the discharge valve clamping ring 60. Further, the discharge valve clamping ring 60 can be pressure joined to the movable scroll 20 without requiring any special means, such as a bolt, in order to couple or affix the discharge valve clamping ring 60 to the movable scroll 20.

Figure 4:
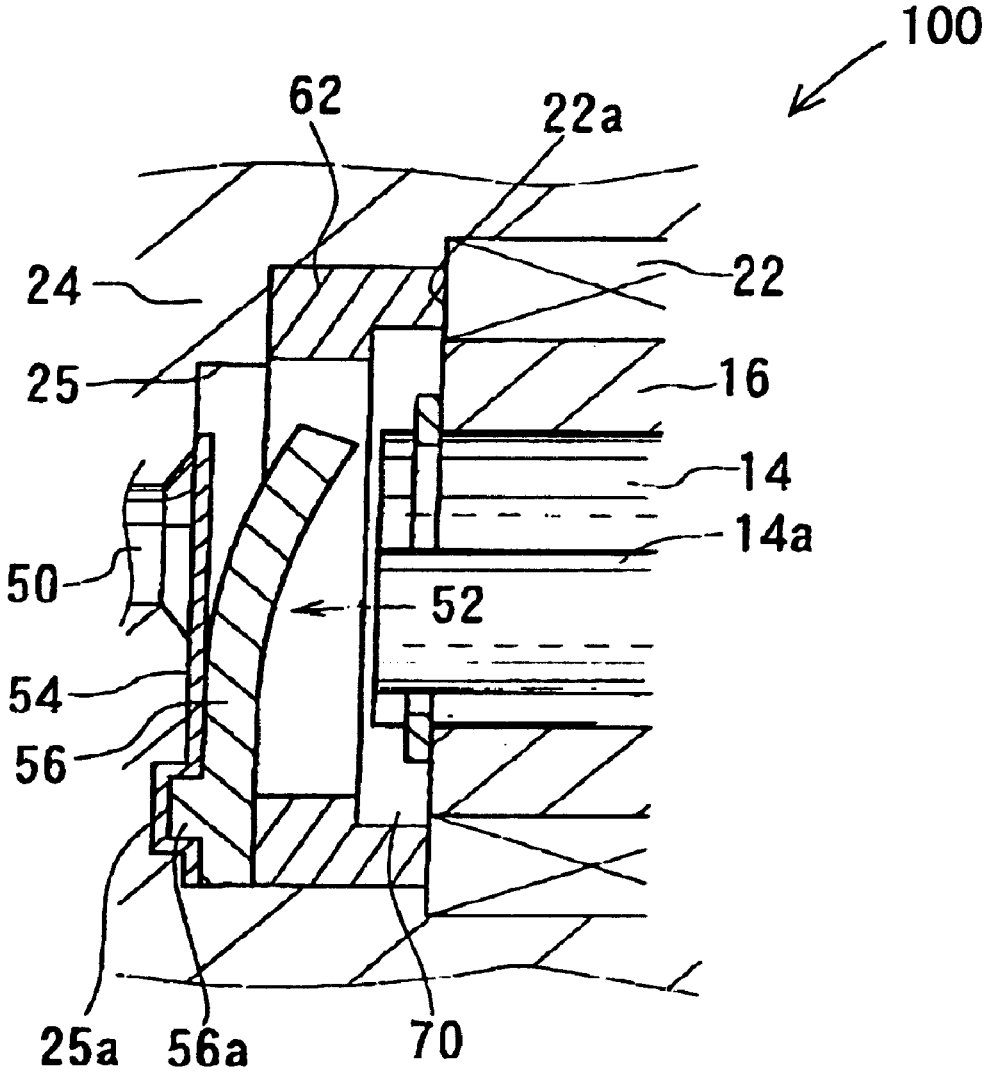
FIG. 4 is a partial cross-section of a scroll compressor of a second representative embodiment.

A second representative embodiment is shown in FIG. 4, which shows a partial cross-Section of the scroll compressor 100. Because a substantial portion of the elements of the scroll compressor 100 are similar to the elements described with respect to the scroll compressor 1 according to the first representative embodiment, only the elements differing from the first representative embodiment will be described. Further, elements that are substantially identical to the corresponding elements of the first representative embodiment are identified in FIG. 4 with the same reference numbers that were utilized in FIG. 2.

As shown in FIG. 4, a positioning groove 25*a* is defined in the movable scroll base plate 24. A positioning protrusion 56*a* is defined on the valve guard 56 and is coupled to the positioning groove 25*a*. Preferably, the positioning protrusion 56*a* may be press-fitted (i.e. frictionally fitted) within the positioning groove 25*a*. By coupling the positioning protrusion 56*a* to the positioning groove 25*a*, the reed valve 54 and the valve guard 56 can be accurately positioned with respect to the movable scroll base plate 24. In other words, it becomes relatively simple to position the discharge valve 52 by disposing the positioning protrusion 56*a* within the positioning groove 25*a*. The positioning protrusion 56*a* and the positioning groove 25*a* serve as one representative example of an engaging member having a concave-convex structure according to the present teachings.

A ring-shaped discharge valve clamping ring 62 is disposed between the discharge valve 52 and the needle bearing 22. The reed valve 54 and the retainer 56 are clamped or secured between the movable scroll base plate 24 and the discharge valve clamping ring 62. The discharge valve clamping ring 62 contacts the end portion 22*a* of the needle bearing 22. That is, the discharge valve 52 is pressed against the movable scroll base plate 24 by the needle bearing 22 via the discharge valve clamping ring 62. As a result, the discharge valve clamping ring 62 may possibly revolve in accordance with the revolution of the needle bearing 22 and independent from the movable scroll 20.

However, because the positioning protrusion 56*a* is coupled to the positioning groove 25*a*, the discharge valve 52 can be prevented from moving together with the needle bearing 22 even if the needle bearing 22 causes the discharge valve clamping ring 62 to unintentionally revolve independently from the movable scroll 20. In other words, the joining force between the positioning groove 25*a* and the positioning protrusion 56*a* can effectively resist the rotational force of the needle bearing 22.

The invention is not restricted to the above described representative embodiments and various modifications may be made to the representative embodiments without departing from the present teachings.

For example, the discharge valve 52 may be prevented from moving together with the needle bearing 22 by utilizing both the discharge valve clamping ring 60 fixed to the inner surface of the boss 24*a* of the movable scroll 20 and the positioning protrusion 56*a* engaged with the positioning groove 25*a*.

In the second representative embodiment, the discharge valve clamping ring 62 is sandwiched or interleaved between the discharge valve 52 and the needle bearing 22. However, the discharge valve clamping ring can be omitted. Further, the discharge valve 52 may be clamped by the end portion of the needle bearing 22. In this modification, the discharge valve 52 can be prevented from moving with the needle bearing 22 by means of the joining force between the positioning groove 25*a* and the positioning protrusion 56*a* when the rotational force of the needle bearing 22 acts on the discharge valve 52. Further, the bearing member is not limited to the needle bearing and may be selected from various types of bearings in accordance with the design requirements of the particular scroll compressor.

In the second preferred embodiment, the positioning groove 25*a* is provided on the movable scroll base plate 24 and the positioning protrusion 56*a* is provided on the retainer 56. However, the positioning groove 25*a* may be provided on the retainer 56 and the positioning protrusion 56*a* may be provided on the movable scroll base plate 24.

Further, a seal (not shown) may preferably be provided between the outer surface of the bush 16 and inner surface of the boss 24*a* in order to prevent the compressed high-pressure fluid from leaking to a lower-pressure space within the housing 1*a* via the clearance between the bush 16 and the boss 24*a*. For example, an elastically deformable annular ring or a plain bearing may be utilized as the seal.

Further techniques for making and using scroll compressors are taught in U.S. Patent Publication Numbers 2002-57975 and 2002-64474, both of which are commonly assigned and are incorporated by reference as if fully set forth herein.

What is claimed is:

1. A scroll compressor comprising:

a stationary scroll;

a drive shaft member having a rotational axis;

a movable scroll driven by the drive shaft member, the movable scroll disposed adjacent to the stationary scroll, the movable scroll having a boss and an inner surface of the boss extends in parallel with the rotational axis of the drive shaft member;

a bearing disposed between the boss and the drive shaft member and arranged and constructed to transmit rotational movement of the drive shaft member about the rotational axis to the movable scroll;

a compression chamber defined by a space between the stationary scroll and the movable scroll, wherein fluid is compressed within the compression chamber when the movable scroll revolves or orbits with respect to the stationary scroll;

a discharge port defined within the movable scroll and adapted to discharge the compressed fluid to a side that is opposite of the stationary scroll;

a discharge valve coupled to the discharge port and operable to open and close the discharge port; and a discharge valve clamping device affixed to said inner surface of the boss, wherein the discharge valve clamping device prevents the discharge valve from moving together with the bearing member.

2. A scroll compressor according to claim 1, wherein the discharge valve clamping device comprises a clamping member that is arranged and constructed to clamp the discharge valve between the movable scroll and the clamping member.

3. A scroll compressor according to claim 2, wherein the clamping member is press-fitted within the inner surface of the boss of the movable scroll.

4. A scroll compressor according to claim 1, wherein the discharge valve clamping device is separated from the bearing by a clearance.

5. A scroll compressor according to claim 1, further comprising an electric motor disposed within a motor housing, wherein the motor housing is in communication with the discharge port, the electric motor is coupled to and drives the drive shaft member and wherein compressed fluid from the compression chamber is introduced into the motor housing via the discharge port in order to cool the electric motor during operation.

6. A scroll compressor according to claim 1, wherein the drive shaft comprises a drive shaft and a crank shaft.

7. A scroll compressor according to claim 1, wherein the bearing member comprises a plain bearing.

8. A scroll compressor according to claim 1, wherein the movable scroll further comprises a base plate and the boss extends perpendicularly from the base plate, the discharge valve comprises a reed valve, one of the reed valve and the base plate comprises a first positioning groove, the other of the reed valve and the base plate comprises a first positioning protrusion and the first positioning protrusion is disposed within the first positioning groove so as to prevent the reed valve from moving relative to the base plate.

9. A scroll compressor as in claim 8, further comprising a retainer disposed between the bearing and the reed valve, the retainer comprising a second positioning groove and a second positioning protrusion, the first positioning protrusion being disposed within the second positioning groove and the second positioning protrusion being disposed within the first positioning groove.

10. A scroll compressor as in claim 9, wherein the bearing contacts the discharge valve clamping device.

11. A scroll compressor comprising:

a stationary scroll;

a drive shaft member adapted to rotate about a revolution axis;

a movable scroll driven by the drive shaft member;

a bearing member disposed between the movable scroll and the drive shaft member and arranged and constructed to transmit revolution of the drive shaft member about the revolution axis to the movable scroll;

a compression chamber defined by a space between the stationary scroll and the movable scroll, wherein fluid is compressed in the compression chamber when the movable scroll revolves or orbits with respect to the stationary scroll;

a discharge port defined within the movable scroll and adapted to discharge fluid within the compression chamber to the opposite side of the stationary scroll;

a discharge valve arranged and constructed to open and close the discharge port;

a discharge valve clamp affixing the discharge valve to the movable scroll;

a positioning protrusion defined on one of the discharge valve clamp and the movable scroll; and a positioning groove defined on the other of the discharge valve clamp and the movable scroll, wherein the positioning protrusion is disposed within the positioning groove and prevents the discharge valve from moving together with the bearing member if the bearing member accidentally revolves together with the drive shaft member and independently from the movable scroll.

12. A scroll compressor according to claim 11, wherein the movable scroll comprises a boss extending in parallel with the revolution axis and the discharge valve clamp comprises a clamping ring press-fitted within an inner circumferential surface of the boss.

13. A scroll compressor according to claim 11, wherein the bearing member presses the discharge valve clamp against the discharge valve.

14. A scroll compressor comprising:

a stationary scroll;

a drive shaft member having a rotational axis;

a movable scroll driven by the drive shaft member, the movable scroll disposed adjacent to the stationary scroll, the movable scroll comprising a base plate that extends perpendicularly with the rotational axis and a boss projecting from the base plate and extending in parallel with the rotational axis, wherein the boss has an inner circumferential surface that extends in parallel with the rotational axis;

a bearing member disposed between the movable scroll and the drive shaft member and arranged and constructed to transmit rotational movement of the drive shaft member about the rotational axis to the movable scroll;

a compression chamber defined by a space between the stationary scroll and the movable scroll, wherein fluid is compressed within the compression chamber when the movable scroll revolves or orbits with respect to the stationary scroll;

a discharge port defined within the movable scroll and adapted to discharge the compressed fluid to a side that is opposite of the stationary scroll;

a discharge valve coupled to the discharge port and operable to open and close the discharge port; and means for preventing the discharge valve from moving together with the bearing member if the bearing member accidentally or unintentionally revolves together with the drive shaft member and independently from the movable scroll, the preventing means contacting the inner circumferential surface of the boss.

15. A scroll compressor comprising:

a stationary scroll;

a drive shaft member having a rotational axis;

a movable scroll driven by the drive shaft member, the movable scroll disposed adjacent to the stationary scroll;

a bearing member disposed between the movable scroll and the drive shaft member and arranged and constructed to transmit rotational movement of the drive shaft member about the rotational axis to the movable scroll;

a compression chamber defined by a space between the stationary scroll and the movable scroll, wherein fluid is compressed within the compression chamber when the movable scroll revolves or orbits with respect to the stationary scroll;

a discharge port defined within the movable scroll and adapted to discharge the compressed fluid to a side that is opposite of the stationary scroll;

a discharge valve coupled to the discharge port and operable to open and close the discharge port; and means for clamping the discharge valve to the movable scroll in order to prevent the discharge valve from moving together with the bearing member if the bearing member accidentally or unintentionally revolves together with the drive shaft member and independently from the movable scroll, the clamping means contacting the bearing member.

16. A scroll compressor comprising:

a stationary scroll;

a drive shaft member having a rotational axis;

a movable scroll having a base plate and driven by the drive shaft member, the movable scroll disposed adjacent to the stationary scroll, wherein a boss extends perpendicularly from the base plate;

a bearing member disposed between the boss and the drive shaft member and arranged and constructed to transmit rotational movement of the drive shaft member about the rotational axis to the movable scroll;

a compression chamber defined by a space between the stationary scroll and the movable scroll, wherein fluid is compressed within the compression chamber when the movable scroll revolves or orbits with respect to the stationary scroll;

a discharge port defined within the movable scroll and adapted to discharge the compressed fluid to a side that is opposite of the stationary scroll;

a discharge valve coupled to the discharge port and operable to open and close the discharge port; and a discharge valve clamping device affixed to the boss, wherein the discharge valve clamping device prevents the discharge valve from moving together with the bearing member if the bearing member unintentionally revolves together with the drive shaft member and independent from the movable scroll, the discharge valve clamping device comprising a clamping ring that clamps the discharge valve against the movable scroll base plate, wherein the clamping ring is press-fit within an inner surface of the boss.

17. A scroll compressor comprising:

a stationary scroll;

a drive shaft member that revolves around a revolution axis;

a movable scroll driven by the drive shaft member and having an annular portion extending generally in the axial direction of the shaft;

a bearing member provided between the movable scroll and the drive shaft member to transmit the revolution of the drive shaft member around the revolution axis;

a compression chamber defined by a space between the stationary scroll and the movable scroll, wherein fluid is compressed in the compression chamber when the movable scroll revolves with respect to the stationary scroll;

a discharge port disposed at the movable scroll to discharge the fluid within the compression chamber to the opposite side of the stationary scroll;

a discharge valve that opens and closes the discharge port; and a discharge valve clamping device fixed to the movable scroll, wherein the discharge valve clamping device prevents the discharge valve from moving together with the bearing member when the bearing member accidentally revolves together with the drive shaft member independent from the movable scroll, the discharge valve clamping device engaging an inner circumferential surface of the annular portion of the movable scroll and separated by a clearance from the bearing member.

18. A scroll compressor comprising:

a stationary scroll;

a drive shaft member that revolves around a revolution axis;

a movable scroll driven by the drive shaft member;

a bearing member provided between the movable scroll and the drive shaft member to transmit the revolution of the drive shaft member around the revolution axis;

a compression chamber defined by a space between the stationary scroll and the movable scroll, wherein fluid is compressed in the compression chamber when the movable scroll revolves with respect to the stationary scroll;

a discharge port disposed at the movable scroll to discharge the fluid within the compression chamber to the opposite side of the stationary scroll;

a discharge valve that opens and closes the discharge port; and a discharge valve clamping device that includes a discharge valve clamping member, a positioning protrusion and a positioning groove, wherein the discharge valve clamping member clamps the discharge valve between the movable scroll and the discharge valve clamping member, the positioning protrusion and the positioning groove engage the discharge valve with the movable scroll such that the discharge valve is prevented from moving together with the bearing member when the bearing member accidentally revolves together with the drive shaft member independent from the movable scroll, the positioning groove is defined on one of the movable scroll and the discharge valve, and the positioning protrusion is defined on the other of the movable scroll and the discharge valve.

* * * * *

UNITED STATES PATENT AND TRADEMARK OFFICE

CERTIFICATE OF CORRECTION

PATENT NO. : 6,544,016 B2 
DATED : April 8, 2003
INVENTOR(S) : Hiroyuki Gennami et al.

It is certified that error appears in the above-identified patent and that said Letters Patent is hereby corrected as shown below:

Title page,
Item [56], References Cited, FOREIGN PATENT DOCUMENTS, please add
-- EP 1 039 136 A2 9/27/2000 --

Column 3,
Line 62, please delete "bush 46" and insert therefore -- bush 16 --.

Signed and Sealed this

Second Day of September, 2003

JAMES E. ROGAN
*Director of the United States Patent and Trademark Office*